United States Patent [19]

Ilsemann

[11] Patent Number: 4,685,277

[45] Date of Patent: Aug. 11, 1987

[54] METHOD AND APPARATUS FOR INTRODUCING COMPACT DISKS INTO COMPACT DISK BOXES

[76] Inventor: Heino Ilsemann, Am Wehkamp 3, 2800 Bremen, Fed. Rep. of Germany

[21] Appl. No.: 915,674

[22] Filed: Oct. 6, 1986

[30] Foreign Application Priority Data

Oct. 12, 1985 [DE] Fed. Rep. of Germany ..... 3536509

[51] Int. Cl.[4] ..... B65B 61/20; B65B 5/12

[52] U.S. Cl. ..... 53/474; 53/238; 53/254

[58] Field of Search ..... 53/445, 474, 468, 238, 53/240, 244, 254, 382, 377, 253, 258

[56] References Cited

U.S. PATENT DOCUMENTS

| | | | |
|---|---|---|---|
| 2,795,906 | 6/1957 | Harker | 53/474 |
| 3,568,395 | 3/1971 | Docili | 53/445 |
| 4,201,027 | 5/1980 | Ilsemann | 53/238 X |
| 4,338,762 | 7/1982 | Gilligan et al. | 53/258 X |
| 4,523,422 | 6/1985 | Ilsemann | 53/238 X |
| 4,539,794 | 9/1985 | Azzaroni | 53/238 X |
| 4,612,752 | 9/1986 | Deal | 53/382 X |

*Primary Examiner*—Horace M. Culver

*Attorney, Agent, or Firm*—Hill, Van Santen, Steadman & Simpson

[57] ABSTRACT

A method for introducing a compact disk into a compact disk box which has a lower part and a lid joined together by a hinge connection characterized by inserting a booklet into the lid where it is retained by lateral noses extending from an inner surface of the lid, inserting a sheet of text material into the bottom part, inserting a tray onto the sheet of material and then inserting a compact disk onto the tray. The invention is also directed to an apparatus having a turret with a plurality of box holders spaced radially from the turret and with work stations with the same spacing so that as the turret is rotated through a segment of an arc it presents one work holder successively to each of the stations.

24 Claims, 10 Drawing Figures

METHOD AND APPARATUS FOR INTRODUCING COMPACT DISKS INTO COMPACT DISK BOXES

BACKGROUND OF THE INVENTION

The present invention is directed to a method for introducing compact disks (CD's) into compact disk boxes, which boxes have a lower part and a cover part or lid with lateral retaining noses which parts are joined together with a hinge-like connection. The method involves opening the box, inserting a booklet which is retainable in the cover part or lid by means of laterally retaining noses, inserting a printed sheet of text into the lower part, inserting a tray on the printed sheet, then positioning a compact disk on the tray and then closing the box. The invention is also directed to an apparatus which is suitable for implementing the above mentioned method of introducing compact disks plus a booklet plus a sheet of printed material and tray into a compact disk box which has a lower part and a cover or lid joined thereto with a hinge-like connection.

Compact disks are enjoying increasing popularity, particularly because of their considerable better recording and play-back qualities in comparison to traditional records. Compact disks boxes are manufactured of transparent plastic material and usually serve for the transporting and storing of the compact disk. These compact disk boxes are composed of a lower part and a cover part or lid which is joined thereto with a hinge-like connection. A sheet of printed text is inserted to lie on the inside surface of the lower part and has edge regions preferably folded up at two opposite edges, a plastic tray is inserted into the lower part and has formed a projection for centering and holding the compact disk. A booklet of materials, such as a text, is also inserted into the compact disk box and this booklet is held adjacent an inside surface of the cover or lid by means of retaining noses on the inside surface of the lid.

The manual introduction of the various components into a compact disk box is work intensive. On the other hand, an automatic packaging of the compact disk with the booklet and the sheet of printed material has not been possible especially because the "threading" of a relatively thick and bulky booklet behind the retaining noses of the lid is only partly successful. In addition, the very light, single sheet of text tend to arch or to bend when inserted into the bottom part due to electric static charges that may potentially occur there.

SUMMARY OF THE INVENTION

It is the object of the present invention to create a method as well as an apparatus which enables compact disks with booklets and/or single sheets of text as well as trays to be automatically inserted into a compact disk box with a high throughput and a low rejection rate with advantages similar to those obtainable when packaged cassettes and folding boxes in accordance with the teachings of German Pat. No. 28 33 862 (U.S. Pat. No. 4,201,027), whose disclosure is incorporated by reference thereto.

In the method of the present invention, this object is achieved in accordance with the invention and the booklet has its back edge placed against the inside surface of the cover or lid in a seating fashion close to the front edge thereof facing away from the hinge axis and the front edge of the booklet facing away from the back edge thereof is pushed into its final position behind retaining noses of the cover part under pressure.

A special embodiment of the method of the invention provides that before insertion into a cover part or lid, the booklet is provided with a bendable prestress which urges the back edge against the inside surface of the cover or lid during insertion. It is thereby provided that before insertion into a cover part, the booklet is bent around an axis lying parallel to its back edge.

It can also be provided in accordance with the invention that after removal from a stack of booklets, the text booklet is stretched in a direction perpendicular to its back edge.

For achieving the aforementioned objects, the apparatus of the invention is characterized by at least one turret head preferably arranged with a vertical rotation axis, the turret head has a plurality of holding devices preferably comprising pivotal suction plates or the like for picking up, opening and closing, and releasing the respective compact disk boxes. The turrent moves in a counterclockwise rotation to present each of the holding devices to a plurality of stations in the following sequence, a box insertion station having means for inserting the compact disk box into one of the holding devices, a booklet inserting station having means for inserting a booklet into the lid of the compact disk box, a sheet inserting station with means for inserting a sheet into a lower part of the box, a tray insertion station with means for inserting a tray on the inserted sheet in the lower part, a compact disk inserting station with means for inserting a compact disk onto the tray in the lower part of the box, a lifting out or ejection station with means for closing the lid of the compact disk box and removing the entire box containing the compact disk from the rotating turret head.

The booklet insertion station includes a transfer device or means for transferring the bottom booklet of a stack of booklets and for stretching the booklet in the direction lying perpendicular to its back edge. The invention also provides under given conditions that the transfer device comprises at least two suction means arranged at different distances from the stack of booklets and a roller arrangement that grips the back edge of the booklet and pulls the booklet off of the suction means. In accordance with the invention, the transfer device comprises two first suction means arranged close to a back edge of the stack of booklets and also comprises a second suction means which is at a greater distance from the back edge of the stack of booklets than the first suction means and essentially lies on a mean perpendicular of a connecting line of the two first suction means. The roller arrangement comprises a stationary and pivotal roller which is movable to seize the back edge of the text booklet respectively held by the suction means.

A further embodiment of the invention provides that the transfer device is followed by a bending device for prestressing the booklet around an axis lying parallel to its back edge with the curvature that is convex with respect to the inside surface of the cover part or lid of the box. The bending device may comprise an essentially planar support plate provided with a channel proceeding parallel to the back edge of the booklet and an impart beam or die that cooperates with the channel to bend the booklet therebetween. The bending devices may comprise a plurality of roller systems having at least three rollers and a nip curved in accordance with the desired bending stresses. In another embodiment, the bending device comprises a support plate composed of two parts which are pivotally connected to one another around an axis extending parallel to the back edge of the booklet and are pivoted relative to one another for bending the booklet.

The booklet insertion station also comprises a reciprocating seating device moving in the direction towards the lid part of the respective compact disk box for seating the back edge of the booklet against the inside surface of the lid close adjacent a front edge of the lid which edge is facing away from the hinge axis of the hinge connection for the box. The insertion station also includes a reciprocated ram or the like for pushing the text booklet into its final position behind the retaining noses of the lid with the booklet having its back edge sliding along the inside surface of the lid.

Immediately following the booklet insertion part, the apparatus includes and insertion means for taking a sheet of printed text from a stack of sheets preferably folding it at two opposite sides and inserting it into a lower part of the compact disk box. The insertion means is provided with an insertion plate movable in a reciprocal fashion perpendicular to the inside surface of the lower part and is equipped with suction devices as well as with pressing dies or ejection pins. Under given conditions, the pressing dies or ejection pins are withdrawn as the sheet is held on the suction device of the insertion plate and is seating against the inside surface of the lower part after the suction is relieved on the suction device of the insertion plate and the plate is lifted from the bottom part, the pins or pressing dies will hold the sheet in the bottom as the plate is removed.

A further embodiment of the invention provides that the compact disk insertion station comprises an air pillow conveying means for moving a respective compact disk into a transfer position and the means has guide rails and a slanted precentering detent following these. As can be provided, the invention has a precentering detent which is fashioned as one piece with the guide rails and as an extension thereof. A further embodiment of the invention is characterized by a centering plate with a suction device and a centering pin for centering the compact disk relative to the device as the suction device picks up the compact disk, transfers it over to a position for lowering on a tray which has been inserted into the bottom of the compact disk box. The centering pin is conically fashioned and is spring loaded so as to urge the disk onto the tray as the vacuum or suction is removed.

In one embodiment of the invention, the centering pin can be moved back and forth relative to the centering plate preferably pneumatically.

The automatic packaging with a high throughput of compact disks with booklets, sheets of printed information inserted into the bottom of the boxes along with trays without having sufficient reject rates occurring is achieved by means of the apparatus of the invention with respect to these controls, the aforementioned of the German Pat. No. 28 33 862 which treats a similar problem in this respect is referenced. The apparatus of the invention works in an extremely reliable fashion and with the lowest possible outlay for personnel. It should be noted, that the controls can utilize various switches or sensors to determine beginning and ending of each operation at each of the stations and to control the rotation of the turret after completion of each of the steps at each of the stations in a conventional manner.

DESCRIPTION OF THE PREFERRED EMBODIMENTS

Figure 1:
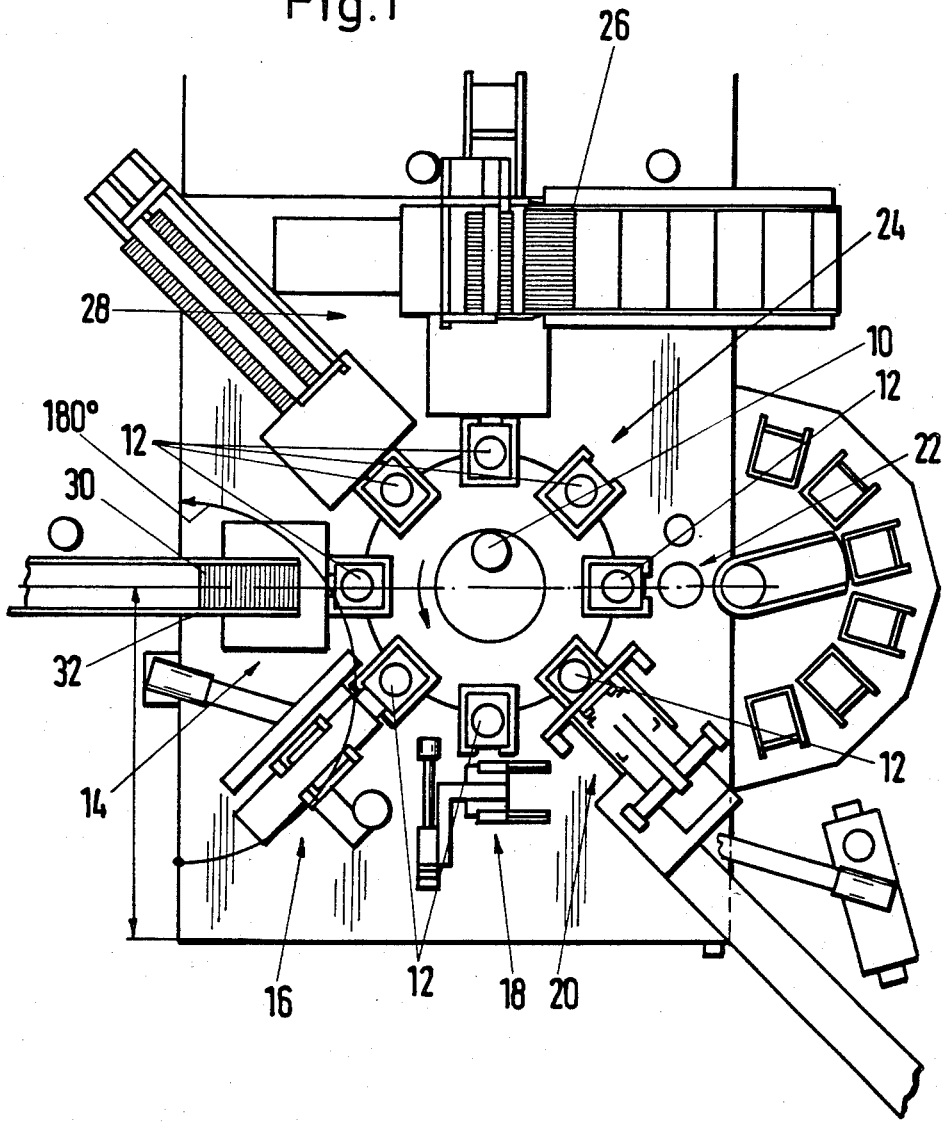
FIG. 1 is a plan view of an exemplary embodiment of the apparatus in accordance with the present invention.

The principles of the present invention are particularly useful when incorporated in an apparatus illustrated in FIG. 1. The apparatus in FIG. 1 includes a turret head 10 which is arranged with a vertical rotational axis and is provided with eight holding mechanisms 12 which are equally spaced around its circumference. Each of these holding mechanisms 12 is intended for picking up a compact disk box and is provided with automatically controlable closing and opening mechanisms for the boxes. Fundamentally, the turret head 10 with the holding mechanisms 12 functions in a corresponding modified way similar to the device of the German Pat. No. 28 33 862 which is designed as an apparatus for the insertion of tape cassettes into foldable boxes.

Positioned around a circumference of the turret head 10, which is moved in a counterclockwise fashion, are box insertion stations 14, a booklet insertion station 16, a sheet insertion station 18, a tray insertion station 20, a compact disk insertion station 22, a closing station 24, an ejection station 26 and a reject removal station 28 to which the holding mechanisms 12 are successively supplied during the counterclockwise rotation of the turret head 10 in the direction of the arrow of FIG. 1.

The box insertion station 14 comprises a refillable box stack 30 formed of a plurality of closed compact disk boxes 32 which are supplied to reside slightly slanted stack. The individual box is transferred from the stack into holding mechanisms 12 by means of a transfer device comprising a suction plate.

Figure 2:
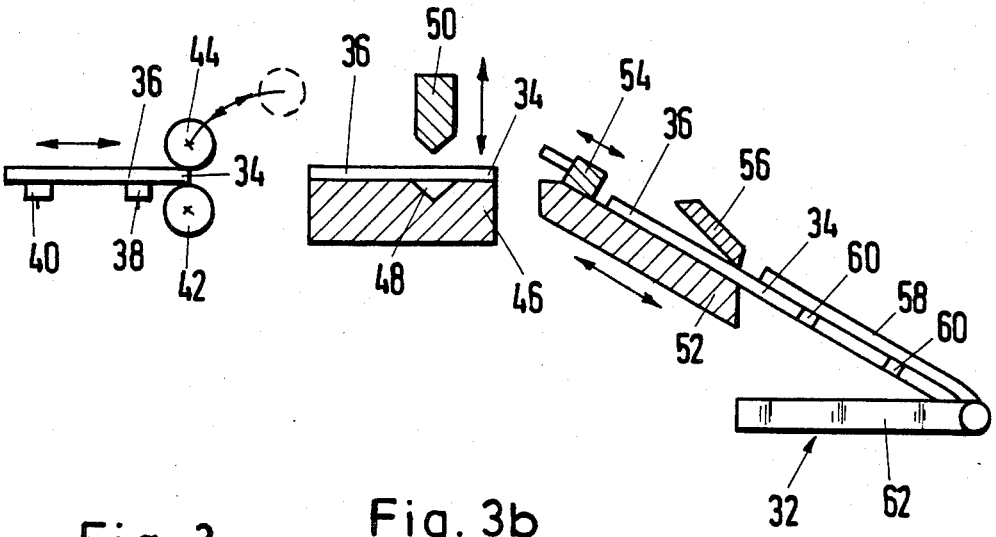
FIG. 2 is an exemplary embodiment of the booklet insertion station with portions broken away for purposes of illustration which station is utilized in the apparatus of FIG. 1.

The booklet insertion station 16 comprises essentially a vertical stack (not shown in FIG. 1) of booklets from which the respective bottom booklet held at its side by means of retaining pins can be removed upon sag by means of a transfer device which is shown in the left hand side of FIG. 2. The transfer means or device comprises two first suction means 38 arranged close to a back edge 34 of the booklet 36 which suction means are arranged essentially at equal distances from the back edge 34 of the booklet 6 and also comprises an additional or second suction means 40 which is at a greater distance from the back edge 34 of the booklet 36 than the first suction means 38 and lies essentially perpendicular to a line interconnecting the first suction means 38. As shown in FIG. 2, the transfer device further includes a roller arrangement having a lower, stationary rotatable roller 42 that is driven and having an upper, pivotally seated roller 44. The above described transfer device is followed by a bending device having a support plate 46 whose supporting surface for the booklet 36 comprises an elongated, V-shaped channel 48 that extends parallel to the back edge 34 of the booklet 36. An impact beam or die 50, which is moved vertically up and down, is arranged above the supporting plates 46. As the above described bending device is followed by an inserting device 52, which is movable by a in a reciprocal fashion in the direction of illustrated arrows and comprises a ram 54 likewise movable in a reciprocal fashion in the direction of the illustrated arrows and comprises a mouth piece 56 which serves for the actual insertion of the booklet into a cover or lid part 52 of a compact disk box 32 shown in an open position in FIG. 2. The cover or lid 58 is provided with retaining noses 60 on an inside surface and is joined by a hinge-like connection to a lower part or bottom part 62.

Figure 3A:
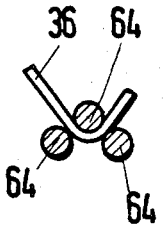
FIGS. 3*a*, 3*b* and 3*c* are cross sectional views of three embodiments of bending devices for bending the booklet in accordance with the present invention.

Embodiments of the bending device can also be fashioned differently from the bending device of FIG. 2. For example, as illustrated in FIG. 3*a*, a roller arrangement comprising three bending rollers 64 whose nip are set such that the booklet 36 is provided with a desired bending prestress. In another embodiment, a curved supporting plate 46*a* (FIG. 3*b*) in combination with a row of bending rollers 64*a* to create the desired bending stress. In another embodiment illustrated in FIG. 3*c*, a roller arrangement comprising a plurality of upper and lower bending rollers 64*b* are provided and the text booklet 46 can also be provided with a desired bending prestress thereby. Departing from the exemplary embodiments shown in the drawings, it is also possible to provide a supporting plate similar to 46 that is composed of two parts pivotable relative to one another in a hinge-like fashion around an axis that extends parallel to the back edge 34 so that a booklet situated on the supporting plate would then be correspondingly bent by means of a brief actuation of the hinged plates.

Figure 4A:
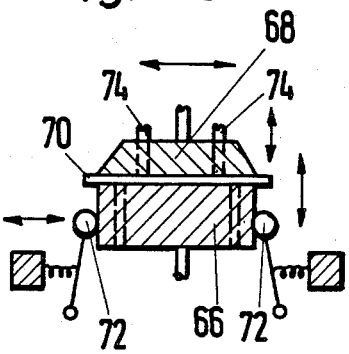
FIGS. 4*a*, 4*b*, and 4*c* illustrate the sheet of printed material insertion station with FIG. 4*a* showing the gripping of a sheet and forming the folded edges, FIG. 4*b* showing the transfer of the sheet to a position above the bottom part and the insertion shown in broken lines and FIG. 4*c* illustrating the removal of the inserting device while maintaining the sheet in the box.
Figure 4B:
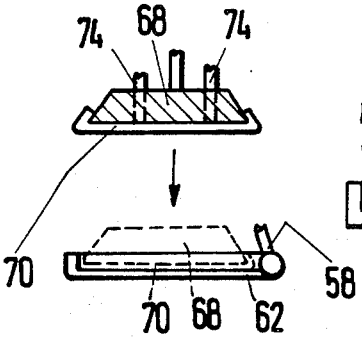
Figure 4C:
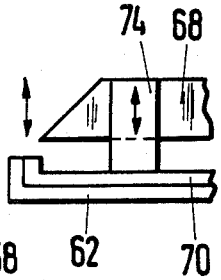

The sheet insertion station 18 of the apparatus of the invention is shown in greater details in FIGS. 4*a*, 4*b*, and 4*c*. The station includes a lower suction plate 66 horizontally movable in a reciprocal fashion in the direction illustrated by the arrow in FIG. 4*a* and an insertion plate 68 which also is a suction plate which is arranged thereabove. The insertion plate 68 comprises lateral slanting seating faces or edges surfaces around which the sheet insert 70 which is positioned between the suction plate 66 and the insertion plate 68 can be folded with the assistance of spring-loaded pressure rollers 72. The arrangement operates in the following manner. A sheet 70 engaged between the plates 68 and 66 is moved vertically downward as illustrated in FIG. 4*a* so that the rollers 72 rolling along the edge of the plate 66 will fold the edges of the sheet over the beveled or slanting edge surfaces. This will form creases such as illustrated in FIG. 4*b*. The inserton plate 68 also includes dies or injection pins 74, which can be withdrawn from the seating surface that engages the sheet 70.

After folding the sheet 70, as illustrated in FIG. 4*a* to produce the structure of FIG. 4*b*, the insertion plate 68 is positioned above the bottom portion 62 of the box and then is lowered as illustrated in broken lines to place the sheet in the bottom 60. Then, the injection pins or pressing dies 74 are shifted to hold the sheet in the bottom portion 62 as the plate 68 is raised as illustrated in FIG. 4*d*.

Figure 5:
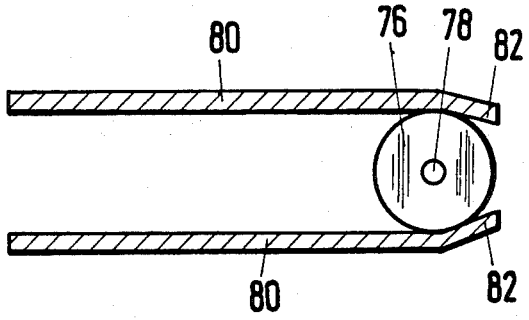
FIG. 5 is a plan view with portions broken away for purposes of illustration of a conveying means for the compact disk insertion station of the apparatus.
Figure 6:
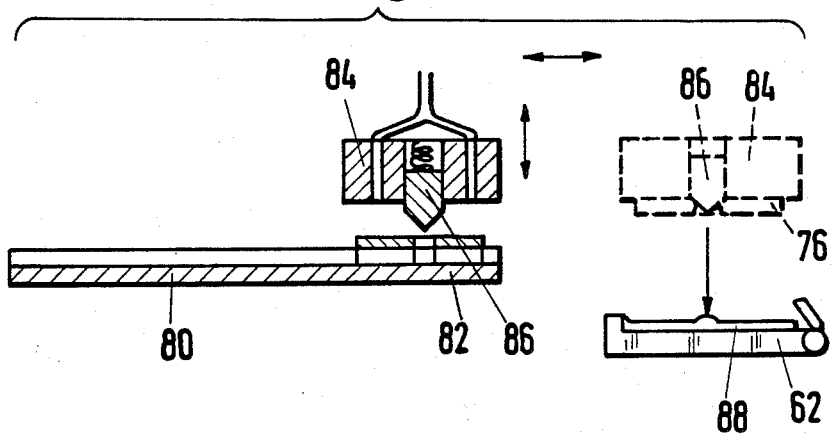
FIG. 6 is a side view with portions broken away for purposes of illustration of the conveying means of FIG. 5 with the position of the transfer device for the plate being illustrated in broken lines over the base or bottom of the compact disk box.

FIGS. 5 and 6 show a detail of the examplary embodiment of the compact disk insertion station 22 of the apparatus of the invention. Compact disks, such as 76, will have a central bore 78 and can be introduced on a known air pillow support means having laterial guide rails 80 which extend from the left to the right as illustrated in FIG. 5. Close to their end shown at the right of FIG. 5, the rails 80 are fashioned to be converging towards one another to form a slanting precentering detent 82.

As illustrated in FIG. 6, the compact disk insertion station includes a centering plate 84 fashioned as a suction plate that can be moved vertically up and down and which has a centering pin 86 that is resiliently biased in a center aperture. The pin 86 is urged into the bore 78 as the plate 84 is moved down to a position for engagement with the compact disk 76. As suction is applied, the disk will be lifted from the lower pillow support means having the precentering detents 82 and then the disk 76 and the plate 84 are shifted laterally to a position illustrated in broken lines in FIG. 6 over the bottom or base part 62 of the box which bottom has already received a tray 88.

The above described apparatus operates in the following manner. In the box insertion station 14, a compact disk box 32 is taken from the stack 30 by means of a suction transfer device and is deposited in the holding device 12 of the turret head 10 momentarily allocated or positioned with the box insertion station 14. Upon forwarding of the turret head 10 in the direction of arrow, a cover or lid part 58 of the box 32 is flipped up in a fashion similar to that set forth in the tape cassette folding boxes in the above mentioned German Pat. No. 28 33 862 so that the lid 58 is in an open position at the moment of which the appertaining compact disk box 32 is in the holding device 12 and arrives at the booklet insertion station 16.

In the booklet insertion station 16, the bottom booklet 36 is downwardly withdrawn from the corresponding stack of booklets by the suction means 38 and 40 while being slightly bent. With the booklet engaging the roller 42, the roller 44 is swiveled to an engagement position and the back edge 34 of the booklet 36 is seized and pulled towards the right as seen in FIG. 2 over the suction means 38 and 40 against a rubber-eraser-like resistance so that the booklet is stretched. Alternately thereto, it also can be provided that only the suction means 38 is initially relieved of the vacuum or suction so that while the booklet 36 is being pulled off of the roller, the suction means 40 remains charged with the suction potentially to a lesser degree to cause the stretching to be further promoted.

Following the stretching, the booklet 36 proceeds to the supporting plate 46 as illustrated in the center of FIG. 2 and there the booklet 36. When the booklet reaches the position on the plate 46, the die or ram 50 moved down and in collaboration with the channel 46 bends the booklet. The booklet is bent slightly around a bending axis extending parallel to its back edge 34. As a result of this bending, the booklet is provided with an internal prestress which leads to the fact that the back edge 34 having a bias intended to move upward. As illustrated in the right hand side of FIG. 2, the application of the bending prestress as set forth above, the booklet proceeds into the positioning or insertion means 52 and this is promoted by the mouth piece 56 which orients the booklet 36 relative to the opened lid 58 of the compact disk box situated in the booklet insertion station 14. The back edge 34 of the booklet 36 comes to lie against the front inside edge of the lid 58 which edges faces away from the hinged axis of the box 32 and lies against this inner surface with a slight pressure acting against the inside seating surface caused by the bending prestress that has been applied. The ram 54 then moves the booklet 36 into the lid 58 in a sliding fashion and into the final position situated behind the retaining noses 60 wherein the back edge 34 always acts as a guide edge and lies flush against the inside surface of the lid 58 as a result of the bending prestresses that have been applied. Accordingly, a reliable insertion of the booklet behind the retaining noses 60 is guaranteed.

Figure 3B:
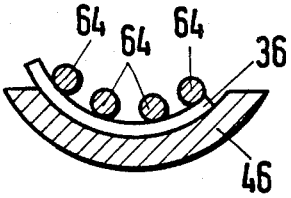
Figure 3C:
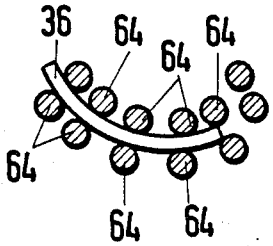

As already set forth, other possibilities of applying the desired bending prestress to the booklet 36 are shown in FIGS. 3*a*, 3*b* and 3*c*. The booklet 36 receiving the desired bending prestress which passes through anyone of the three roller arrangements.

Subsequent to the insertion of the booklet into the lid, the CD box 32 now moves to the sheet of printed material inserti station 18 wherein the cover is still held in the open position and the bottom sheet 70 of a stack of sheets is taken in this station by means of a suction plate 66 and is placed in the position shown in FIG. 4*a*. The insertion plate 68 then lowers onto the suction plate 66. The suction plate 66 and the insertion plate 68 then move down as illustrated in FIG. 4*a* so that the pressure rollers 72 fold the edges of the text sheet 70 around the appropriate edge surfaces of the insertion plate 66 in order to achieve the desired folded arrangement.

Subsequently, the suction plate 66 is relieved of its suction and the insertion plate 68 is either charged with the suction or remains charged with the suction whereupon the insertion plate 68 with the folded sheet 70 as illustrated in FIG. 4*b* is moved away from the suction plate 66 to a position above the bottom part 62 of the compact disk box. Next, the insertion plate 68 with the sheet 70 held thereto by means of the corresponding suction is lowered into the lower part 62 of the compact disk box 32 allocated to the sheet insertion station 70 at that moment. As soon as the insertion plate 68 has brought the sheet 70 against the inside surface of the lower or bottom part 62 in a seated fashion, the sheet 70 is reliable held seated against the inside the surface of the lower part 62 with the extendable pressing dies or pins 70 in a way shown in FIG. 4*c* as the insertion plate 68 is simultaneously lifted off of the bottom. It is thereby assured that even given a potential electo-static charge of the sheet 70 produced in the box 32 which is usually composed of a transparent plastic material, it is reliably guaranteed that the sheet 70 will not be lifted from the inside surface of the lower part 70 together with the insertion plate 68 but will remain smoothly seated. Alternately, to the above described procedure wherein the pins 70 move relative to the insertion plate are used, it can also be provided that an ionizing device, for example, would cause a corresponding change in electro conductivity of the insert 70 when seating against the inside surface of the lower part 62 in order to thus, avoid the negative effect of electro-static charges in this manner.

An upward bending or curling as a consequence of the fact that the booklet is printed in different ways and bending stresses derived therefrom can also be countered by means of the bending stress provided in accordance with the invention. Thus, the curling of the booklet can produce difficulties not only during the insertion operation but also during use when the cover part or lid is hinged up relative to the lower part or bottom of the compact disk box because the booklet could then slide into the hinged region of the box 32.

After inserting the sheet 70, the holder then moved to the tray insertion station 20 wherein a tray 88 is inserted on the inserted sheet 70. After this has been accomplished, then the holder 12 with the box having the sheet, the booklet and the tray is then positioned at the compact disk insertion station 22 so that a compact disk 76 with a central bore 78 can be inserted. The compact disk 76 is introduced from the left of FIG. 5 on an air pillow and is already precentered with respect to the longitudinal center line of the guide rails 80 and thus, relative to a centering plate 84 as well as being precentered by a slanting precentering detent 82. The centering pin 86 extends below the centering plate 84 and effects a final centering of the compact disk 76 relative to the plate 84 whereby the disk is now fixed in its exact center position by means of a suction applied to the centering plate 84. The centering plate 84 with the compact disk 76 is then positioned over the bottom part 62 having the tray 88 and then lowered to deposit the disk 76 onto the tray as shown in broken lines on the right side of FIG. 6. The exact positioning of the compact disk 76 on the corresponding shaped tray surface is guaranteed because of the exact centering of the disk relative to the centering plate 84. Subsequent to the lowering the disk 76 onto the tray 88, the vacuum is removed from the vacuum centering plate 84 so that the disk is deposited on the tray.

The above described apparatus can, of course, work in a fully automatic fashion by means of appropriate electrical, electronic, pneumatic, mechanical and/or hydraulic drives and control elements. It is assumed that these control elements can be conventional switches and sensors which determine the location of each of the members in the station and determine when each insertion step has been completed so that the next step can be performed.

After the disk 76 has been inserted in the box, the turret then moves another step to position the box having the disk at a closing station wherein the lid is closed onto the bottom part. After closing, the turret moves another segment to position the holder with the closed box containing the disk at the ejection station. It is assured over an above this that the box 32 perceived as faulty or incomplete will not be ejected in the ejection station 26 which follows the above described operation but is subsequenly lifted out of the respective holding device 12 at a reject ejection station 28 to which the holder is presented after having been presented to the ejection station 26. After the box has been removed either at the ejection station because it is a completed box, or at the reject ejection station 28 because it is a faulty box, the holder is empty and then is positioned at the box inserting station 14 to repeat the operation.

Although various minor modifications may be suggested by those versed in the art, it should be understood that I wish to embody with the scope of the patent granted hereon, all such modifications as reasonably and properly come within the scope of my contribution to the art.

I claim:

1. In a method for introducing a compact disk into compact disk box which has a lower part having a hinge connection along one edge to a lid having an inside surface with retaining noses for retaining a booklet against the inside surface, said method including inserting the booklet, inserting a sheet of printed matter into the lower part, inserting a tray for supporting the compact disk onto the sheet in the lower part, and then inserting the compact disk into the tray, the improvement comprising the step of inserting the booklet including the step of positioning the box with the lid being opened, positioning the booklet with its back edge facing the open lid, moving the booklet with a back edge engaging the inside surface of the lid adjacent a front edge of the lid opposite the hinge connection, applying pressure to slide the booklet into a retained position with the back edge moving towards the hinged connection and the edges of the booklet being retained by the retaining noses of the lid.

2. In a method according to claim 1, wherein prior to inserting the booklet into the lid, providing a bending prestress to the booklet to urge the back edge against the inside surface of said cover part while sliding the booklet into the retained position.

3. In a method according to claim 2, wherein the step of providing the bending prestress bends the booklet around an axis lying parallel to the back edge of the booklet.

4. In a method according to claim 3, wherein prior to bending the booklet to provide the prestress, removing the booklet from the bottom of a stack and stretching the booklet in a direction perpendicular to the back edge.

5. In a method according to claim 1, which includes prior to inserting the booklet into the lid, removing the booklet from a stack and stretching the booklet in a direction extending perpendicular to the back edge of the booklet.

6. An apparatus for introducing a booklet, a sheet of printed material, a tray and a compact disk into a compact disk box which has a lower part having a hinge connection at one edge to a lid with an inside surface with retaining noses, said apparatus including at least one turret head arranged for rotation around a vertical axis and having a plurality of radially extending holding devices with each holding device having pivotally mounted suction plates for picking up, opening, closing and ejecting the compact disk boxes, a plurality of stations being spaced on the circumference of said turret with the spacing being equal to the spacing between adjacent holding devices, said stations including a box insertion station having means for inserting a box into a holding device, a booklet insertion station having means for inserting a booklet back edge first to slide along an inside surface of the lid into a final position with the retaining noses holding the booklet against said inside surface, a sheet inserting station including means for inserting a sheet of printed text into a lower part of said box, a tray inserting station having means for inserting a tray into said lower part on top of said sheet, a compact disk insertion station including means for inserting the disk onto the tray in the lower part, an ejection station having means for removing the filled box, and means for rotating the turret to present each of the holding devices successively at the station with a dwell to enable performing the operation at the particular station.

7. An apparatus according to claim 6, wherein the means for inserting a booklet includes a transfer means for removing a bottom booklet of a stack of booklets and stretching the booklet in the direction extending perpendicular to the back edge thereof.

8. An apparatus according to claim 7, wherein the transfer means comprises at least two suction means arranged at different distances from the back edge of the booklets in said stack and a roller arrangement which grips the back edge of the booklet and pulls the booklet over the suction means.

9. An apparatus according to claim 8, wherein the suction means includes two separate first suction means arranged close to a back edge of the stack of booklets at identical distances therefrom and a second suction means which is positioned a greater distance from the back edge of the booklet in the stack and said first suction means and lies on a mean perpendicular to a connecting line between the two first suction means.

10. An apparatus according to claim 8, wherein the roller arrangement comprises a stationary roller and a movable roller, being pivotally movable to a position to grip the back edge of the booklet being held by the suction means.

11. An apparatus according to claim 7, wherein the transfer means includes a bending means for prestressing said booklet around an axis extending parallel to a back edge of the booklet to provide a curvature that is convex with respect to the inside surface of the lid of the box.

12. An apparatus according to claim 11, wherein the bending means comprises an essentially planar support plate having a channel extending parallel to the back edge of the booklet and includes a ram for coacting with said groove to bend the booklet interposed therebetween.

13. An apparatus according to claim 11, wherein the bending means comprises a roller system comprising at least three rollers, said rollers being positioned to curve a booklet with the desired bending stresses being passed therethrough.

14. An apparatus according to claim 11, wherein the bending means comprises a seated plate composed of two parts pivotally connected to one another around a pivot axis extending parallel to the back edge of the booklet, said parts being pivoted relative to one another for bending the booklet.

15. An apparatus according to claim 7, wherein said means for inserting a booklet includes reciprocating seating means moving in a direction towards the open lid of the box for seating the back edge of the booklet against the inside surface of the lid close to a front edge thereof facing away from the hinge connection, said reciprocating seating means including a reciprocating ram for pushing the booklet into a final position engaged in the retaining noses of the lid with the booklet having its back edge sliding along the inside surface of the lid.

16. An apparatus according to claim 6, wherein the means for inserting a sheet into a lower part of a box includes means for removing the sheet from a stack of sheets having a first suction plate, means for folding the edges of the sheets including an insertion plate coacting with the first suction plate, said insertion plate being reciprocated perpendicular to the inside surface of the lower part and having a suction means for holding the sheet thereon.

17. An apparatus according to claim 16, wherein the insertion plate has pressing dies extending from the lower face of the insertion plate, said pressing dies acting to hold the sheet on the inside surface of the lower part after release of the suction means of the insertion plate and lifting of the insertion plate from the lower part.

18. An apparatus according to claim 6, wherein the means for inserting a disk includes an air pillow conveying means for moving the disk into a transfer position, said air pillow having lateral guidance rails having slanted centering portions adjacent a transfer position.

19. An apparatus according to claim 18, wherein the centering portions are fashioned as one piece with the guide rails of the air pillow conveying means.

20. An apparatus according to claim 18, wherein said means for inserting a disk includes transfer means having a centering plate with suction means and a centering pin for centering a disk on the plate, said suction means holding a compact disk on the plate as the centering plate is moved from a transfer position over the air pillow conveying means to a second position over the tray received in the lower part of the box.

21. An apparatus according to claim 20, wherein the centering pin is conically fashioned.

22. An apparatus according to claim 20, wherein the centering pin is yieldable mounted in the centering plate.

23. An apparatus according to claim 20, wherein the centering pin is mounted with a spring-loading in the centering plate.

24. An apparatus according to claim 20, wherein the centering pin is moved back and forth relative to the centering plate preferably pneumatically.

* * * * *